United States Patent [19]

Glenn et al.

[11] Patent Number: 4,640,208

[45] Date of Patent: Feb. 3, 1987

[54] METHOD AND APPARATUS FOR FORMING DECORATIVE FABRICS

[75] Inventors: Julian H. Glenn, High Point, N.C.; Douglas J. Glenn, P.O. Box 156, Wallburg, N.C. 27373

[73] Assignee: Douglas J. Glenn, Wallburg, N.C.

[21] Appl. No.: 879,424

[22] Filed: Jun. 27, 1986

Related U.S. Application Data

[62] Division of Ser. No. 724,101, Apr. 17, 1985.

[51] Int. Cl.[4] ..... D05B 3/12

[52] U.S. Cl. ..... 112/265.1; 112/101; 112/100

[58] Field of Search ..... 112/412, 262.1, 417, 112/265.1, 420, 100, 421, 101, 88, 61; 28/164, 262, 263

[56] References Cited

U.S. PATENT DOCUMENTS

| | | | |
|---|---|---|---|
| 154,088 | 8/1874 | Rose . | |
| 303,170 | 8/1884 | Levy et al. . | |
| 663,752 | 12/1900 | Grubman . | |
| 711,898 | 10/1902 | Hyatt . | |
| 1,068,506 | 7/1913 | Laurent . | |
| 1,201,490 | 10/1916 | Morris . | |
| 1,321,908 | 11/1919 | Haberman . | |
| 1,410,178 | 3/1922 | Griciunas . | |
| 1,432,974 | 10/1922 | De Voe . | |
| 1,446,808 | 2/1923 | Moore . | |
| 1,515,807 | 11/1924 | Corbin . | |
| 1,616,637 | 2/1927 | Rankin . | |
| 1,622,171 | 3/1927 | Anthony . | |
| 2,049,395 | 7/1936 | Karle . | |
| 2,063,267 | 12/1936 | Perkons . | |
| 2,137,454 | 11/1938 | Litsey | 112/101 |
| 2,253,731 | 8/1941 | Seaman . | |
| 2,309,498 | 1/1943 | Cavalluzzo . | |
| 2,332,833 | 10/1943 | Unger . | |
| 2,374,529 | 4/1945 | Everitt . | |
| 2,449,416 | 9/1948 | Schifrin . | |
| 2,523,690 | 9/1950 | Finkelsteinas . | |
| 2,575,753 | 11/1951 | Foster . | |
| 2,686,484 | 8/1954 | Cuthbertson . | |
| 2,725,837 | 12/1955 | Seaman . | |
| 3,567,567 | 3/1971 | Sherrill . | |
| 4,067,278 | 1/1978 | Davis . | |
| 4,438,713 | 3/1984 | Kato . | |

FOREIGN PATENT DOCUMENTS

| | | |
|---|---|---|
| 1014734 | 8/1952 | France . |

*Primary Examiner*—Ronald Feldbaum

*Attorney, Agent, or Firm*—Bell, Seltzer, Park & Gibson

[57] ABSTRACT

This invention relates to a novel method and apparatus for making novel decorative fabrics wherein effect yarns are present on the fabric with the effect yarn being fed in a longitudinally compressed bulked condition imparting an expanded cross-sectional width to the effect yarn and wherein a stitching thread secures the effect yarn in the compressed bulked condition so that there is imparted to the fabric an appearance attendant to an effect yarn much larger than that actually present on the fabric.

9 Claims, 20 Drawing Figures

METHOD AND APPARATUS FOR FORMING DECORATIVE FABRICS

This application is a division of copending application Ser. No. 724,101, filed Apr. 17, 1985, and entitled "Decorative Fabrics and Attendant Method and Apparatus For Forming Same".

This invention relates to a novel method and apparatus for making novel decorative fabrics wherein preselected yarns are used as effect yarns and are stitchingly secured to a suitable substrate. While fabrics having substrates with effect yarns sewn thereon are well-known, this invention is directed to fabrics formed from effect yarns wherein the effect yarns are in a longitudinally compressed bulked condition imparting an expanded cross-sectional width to the effect yarn. The effect yarn is secured by stitching in this compressed bulked condition to a substrate or if desired, in overlapping relation thereon or in overlapping relation devoid of a substrate. Thus, it will be understood that there is imparted to the fabrics of this invention an appearance attendant to an effect yarn much larger than that actually present on the fabric.

With the foregoing in mind, it is the primary object of this invention to provide a method and apparatus for obtaining a wide variety of different types of decorative fabrics utilizing compressed bulked effect yarns stitchingly secured in compressed bulked condition to a substrate and if desired, in overlapping relation thereon or in overlapping relation devoid of a substrate.

It is a further object of this invention to provide apparatus in association with a sewing machine, preferably a sewing machine of the quilting type, for facilitating the guiding of an effect yarn to the needle of the quilting machine and for facilitating obtaining the desired compressed bulked condition of the effect yarn.

As earlier indicated, the preferred mode for forming fabrics of this invention is through use of a sewing machine of the quilting type wherein the quilting machine is provided with a presser foot but no feed dog so that the operator or attendant for such quilting machine may manually guide the fabric in any desired manner for obtaining the desired decorative pattern.

BRIEF DESCRIPTION OF THE DRAWINGS

Some of the features and advantages of the invention having been stated, others will appear as the description proceeds when taken in connection with the accompanying drawings, in which.

DETAILED DESCRIPTION OF THE ILLUSTRATED EMBODIMENTS

While the present invention will be described more fully hereinafter with reference to the accompanying drawings, in which particular embodiments are shown, it is to be understood at the outset that persons skilled in the art may modify the invention herein described while still achieving the favorable results of this invention. Accordingly, the description which follows is to be understood as a broad teaching disclosure directed to persons of skill in the appropriate arts, and not as limiting upon the present invention.

The Product

The textile fabric of the present invention displays a variety of effects and patterns which may be varied by selecting a yarn such as a plied, textured or single yarn. While the illustrated textile products are directed to specific embodiments of the invention, and generally employ plied yarn, the reader should note that other effects and patterns may be achieved which are within the scope of the invention, but are not illustrated.

The broad textile product comprises a textile fabric F serving as a substrate S and an effect yarn Y arranged thereon in a predetermined manner.

Figure 12:
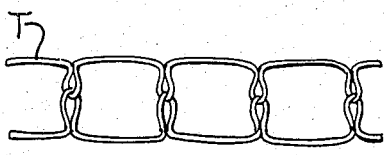
FIG. 12 is an enlarged detail view of the stitching.

In the first embodiment of the invention, the effect yarn Y is attached to a substrate S by stitching, preferably lock-stitching (as shown in FIG. 12), while the effect yarn is in a longitudinally compressed, bulked condition. The lock-stitching penetrates or extends through the effect yarn Y to sustain it in the compressed bulked condition which, in turn, causes the effect yarn Y to have an expanded cross-sectional width, and imparts to the fabric an appearance attendant to the effect yarn being much larger than that actually present on the fabric.

The product may be modified to achieve a chenille-like appearance by selecting a multi-ply yarn Y as the effect yarn. This is achieved by maintaining the effective length of effect yarn (the normal untensioned, unstretched length) between adjacent stitches of stitching in the range of about 1.5 to 8 times the linear distance between adjacent points at which adjacent stitches extend through the effect yarn, with 4 to 5 being the preferred ratio, and penetratingly stitching the effect yarn Y to the substrate S as described above.

In FIGS. 1, 2, 10, 11, 12 the effect yarn is stitched to a quilted fabric F serving as the substrate S. The quilted fabric is composed of opposing outer layers a, b of fabric with an intervening layer c of a suitable filling material sandwiched therebetween, and lines of stitching thread L (FIG. 1) are used to secure layers a, b, c together. These lines of stitching thread L are applied to the quilted fabric in the form of an intricate pattern and form decorative designs thereon. In this embodiment, the effect yarn is stitched onto the quilted fabric so as to generally overlie the lines of stitching L, thereby substantially replicating this pattern and enhancing the decorative value of the quilted fabric.

Figure 10:
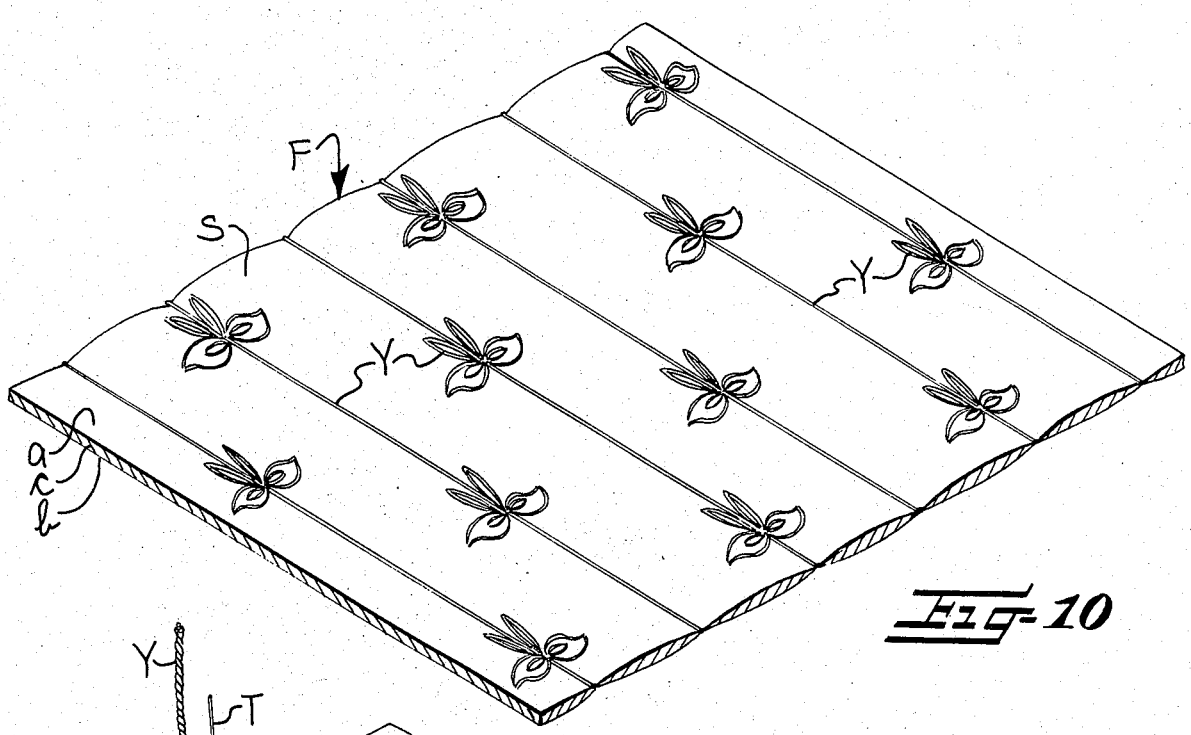
FIG. 10 is a perspective view of a portion of a fabric similar to that shown in FIG. 1.
Figure 11:
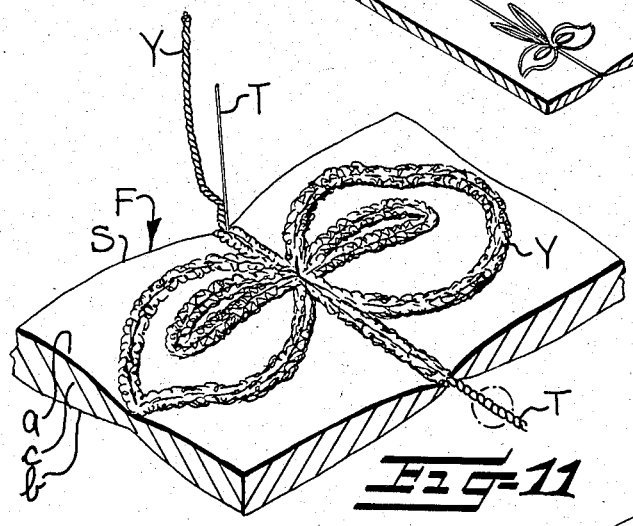
FIG. 11 is an enlarged fragmentary perspective view of a portion of one of the design areas of FIG. 10 and showing the manner in which the effect yarn is secured to the substrate by the stitching thread.
Figure 13:
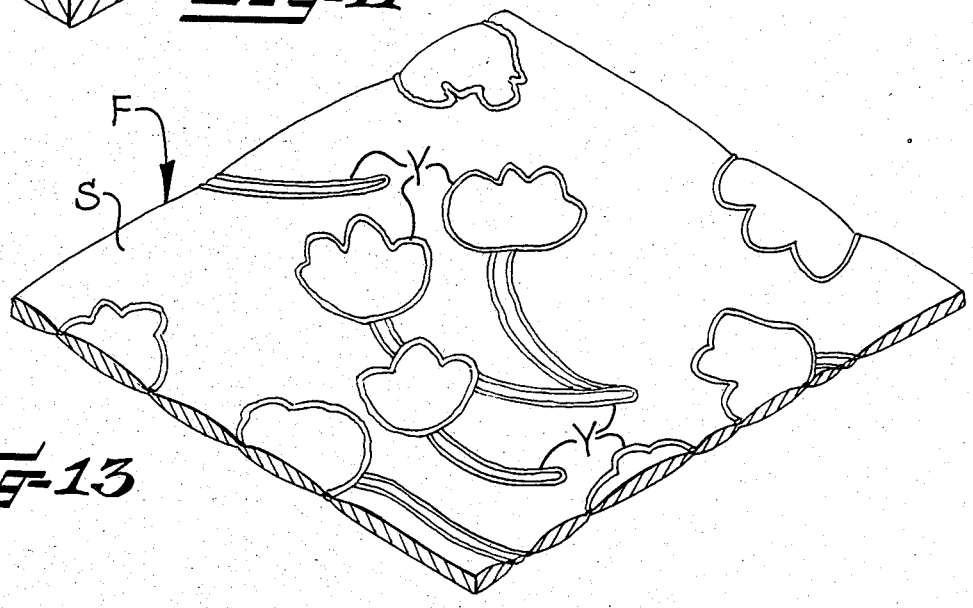
FIG. 13 is a perspective view of a portion of a fabric having an effect yarn pattern thereon differing from that of FIG. 10.

Patterns may be repetitive, as shown in FIG. 10 or may be done in a free-hand manner using a combination of different color effect yarns to form a multicolored design, if desired, or the effect yarns may completely outline portions of a substrate to form a tapestry-like work of art as shown in FIG. 13.

Another innovative product which may be produced according to the invention is a textile fabric formed from an effect yarn Y and a stitching thread T, wherein portions of the effect yarn Y are stitchingly secured by the stitching thread to other portions of the effect yarn in overlapping relation, while the effect yarn is in a longitudinally compressed, bulked condition. Fabrics of this type are shown in FIGS. 16–19, one of which fabrics is indicated at F-a and shows the effect yarn secured to a substrate S, and another of which fabrics is indicated at F-b and is devoid of a substrate. One effect thereby obtained is that an expanded cross-sectional width is imparted to the effect yarn which in turn, causes the fabric to give the appearance of being composed of effect yarn much larger than is actually present as shown in FIGS. 16–19. By way of example one square inch of either of fabrics F-a or F-b would include about 28 linear inches of effect yarn.

Figure 14:
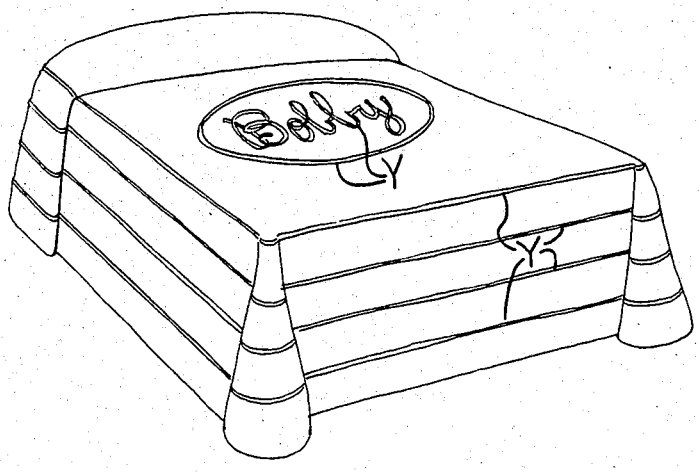
FIG. 14 is a perspective view of a bedspread showing a different pattern thereon from those shown in FIGS. 1, 10 and 13.
Figure 15:
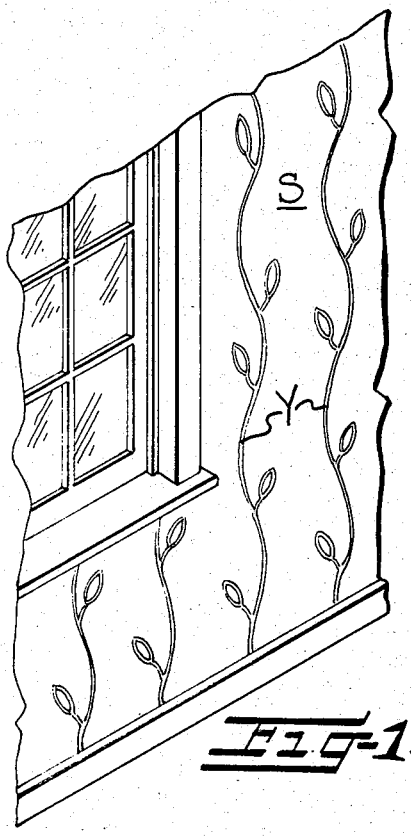
FIG. 15 is a perspective view of a wall covering with an effect yarn pattern thereon.
Figure 16:
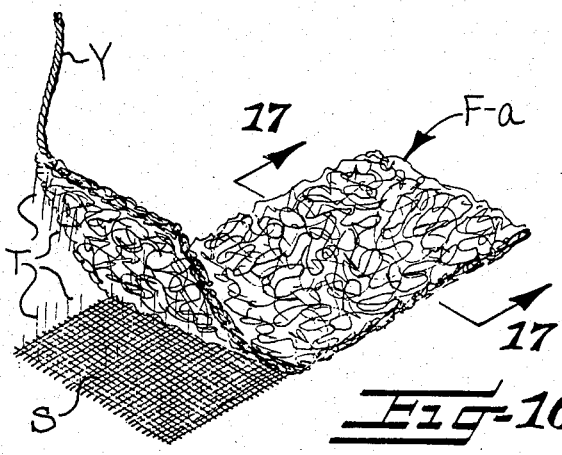
FIG. 16 is a perspective view showing an effect yarn stitched to and substantially covering a substrate.
Figure 17:
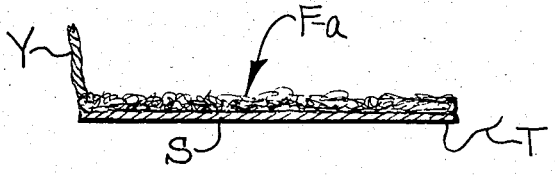
FIG. 17 is a cross-sectional view taken generally along Line 17—17 of FIG. 16.
Figure 19:
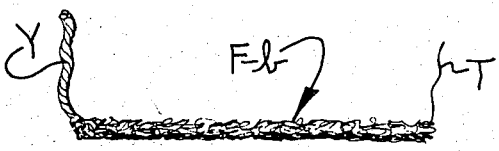
FIG. 19 is a cross-sectional view taken generally along Line 19—19 of FIG. 18.
Figure 18:
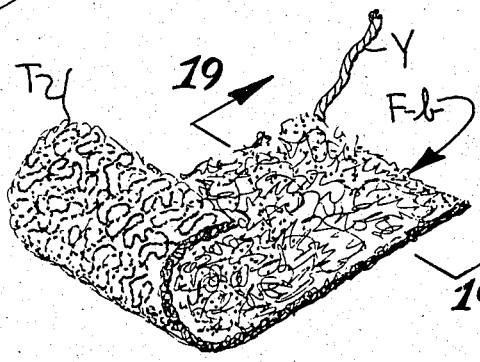
FIG. 18 is a perspective view of a fabric formed of the stitchcd effect yarn onto itself, and being devoid of a substrate.
Figure 20:
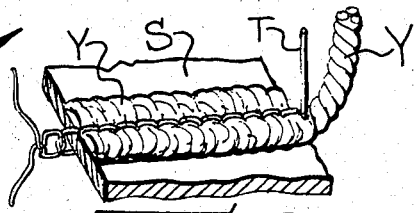
FIG. 20 is a perspective view in detail, showing how the effect yarn is stitched onto a substrate.

The fabrics of FIGS. 14 and 15 are further representative of the designs which may be applied to a substrate S in accordance with this invention. For example, FIG. 14 illustrates a bedspread having straight lines and a large monogram formed thereon of the effect yarn Y applied to the substrate S as described heretofore. By way of a further example FIG. 15 illustrates the substrate in the form of a wall covering with the effect yarn Y similarly applied to the substrate S as described heretofore.

The Apparatus

Referring now to FIGS. 1–9, the sewing machine 100 there shown is in the form of a quilting machine which may be of conventional construction. One advantageous feature of the present invention resides in the fact that the yarn guide apparatus, broadly designated at 200, may be used with virtually any of the standard types of sewing machines or quilting machines, if properly modified. A quilting machine differs from a sewing machine by the noticeable absence of the feed dogs employed to advance the fabric, and further includes a reciprocable pressure foot. The quilting machine is preferred for some applications of the invention because it provides the ability to make complex, non-linear designs on a substrate without varying the axis of the substrate while the effect yarn is being applied; a result heretofore unachievable with a standard sewing machine. Typically, the quilting machine 100 includes a base 110 which supports an upstanding hollow standard 120. Mounted on the upper portion of the standard 120 is a cantilever arm 130, which extends outwardly from the standard and overhangs base 110 and terminates at its free end in a head 140. The head 140 mounts a vertically reciprocable needle bar 150 and a sewing needle 160 mounted thereon. Also carried by head 140 is a vertically reciprocable shaft 170 which is reciprocable in timed relation with needle bar 150 and needle 160. Shaft 170 extends downwardly from the underside of head 140 and terminates in a presser foot 180 which is provided with an opening 181 formed therein. The opening 181 in presser foot 180 is positioned in alignment with the needle 160 and permits the needle, the stitching thread T, and the effect yarn Y to move therethrough. In addition, the quilting machine also includes drive means generally indicated at 190 for vertically reciprocating the needle bar 150 and shaft 170.

Figure 1:
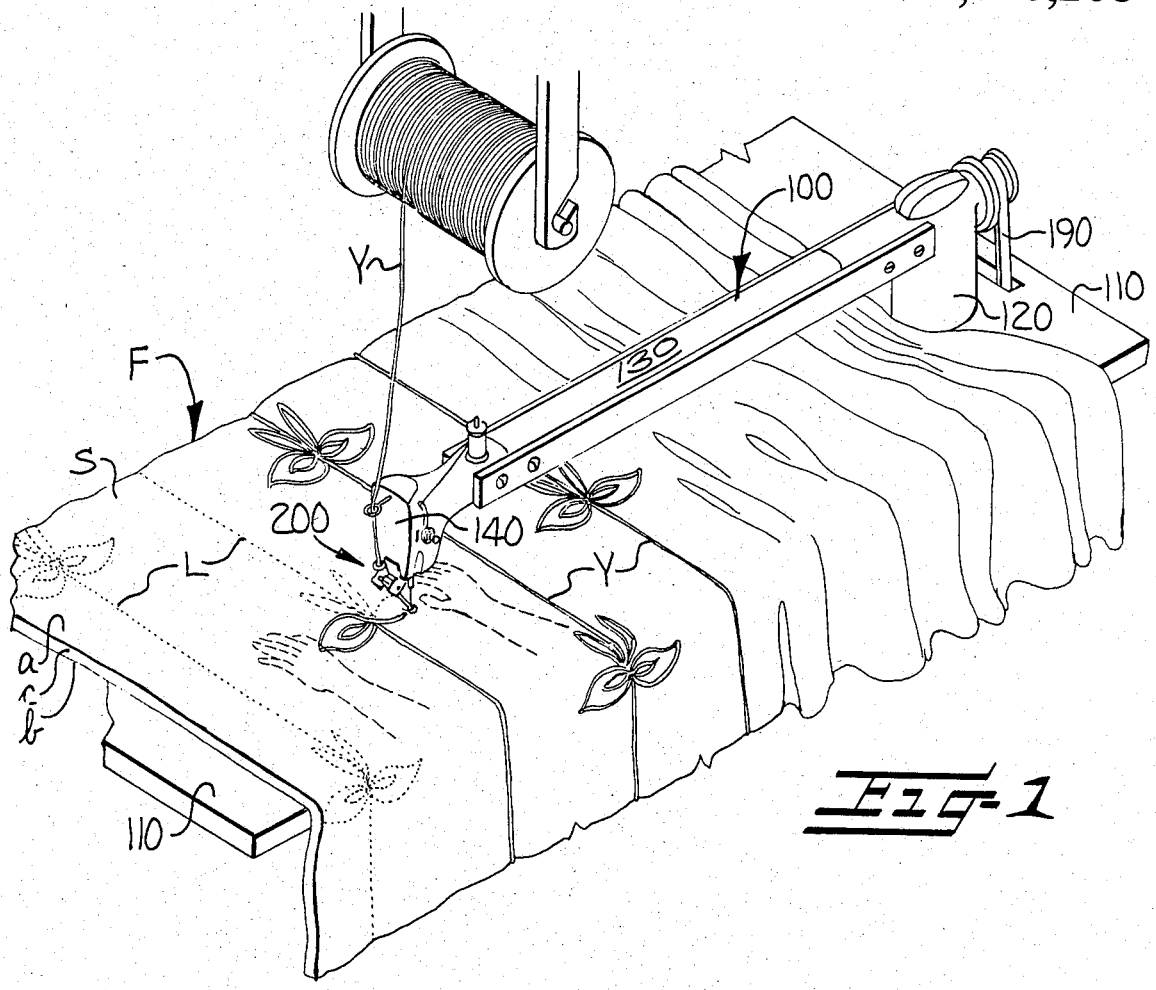
FIG. 1 is a perspective view of a sewing machine; illustrated in the form of a quilting machine, and illustrating one embodiment of the fabric of this invention in the course of its manufacture.
Figure 2:
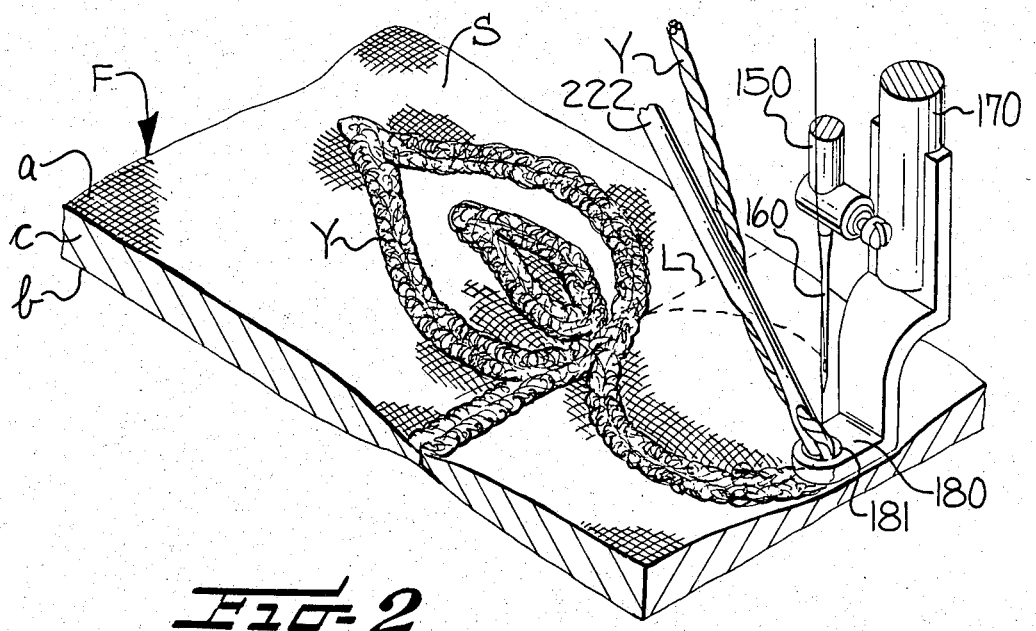
FIG. 2 is an enlarged perspective detail of the yarn guide apparatus of the invention.
Figure 3:
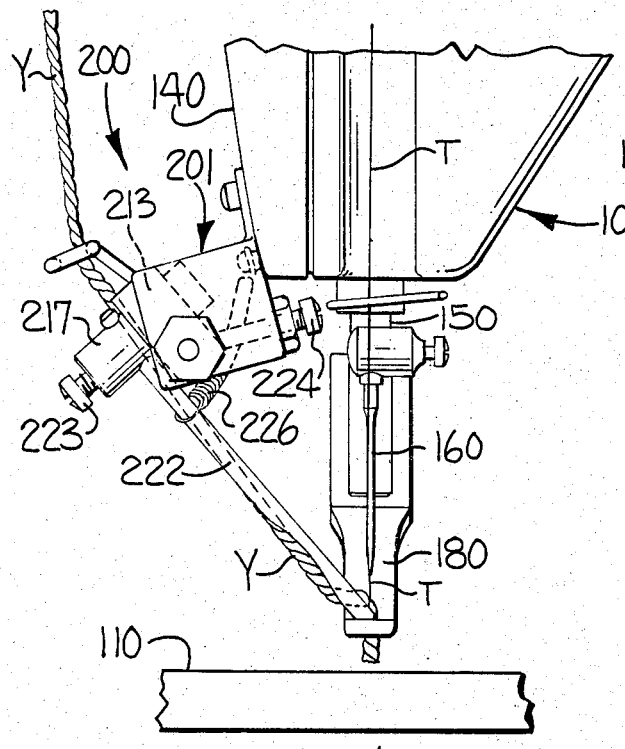
FIG. 3 is a front elevation of the yarn guide apparatus of FIG. 2.
Figure 4:
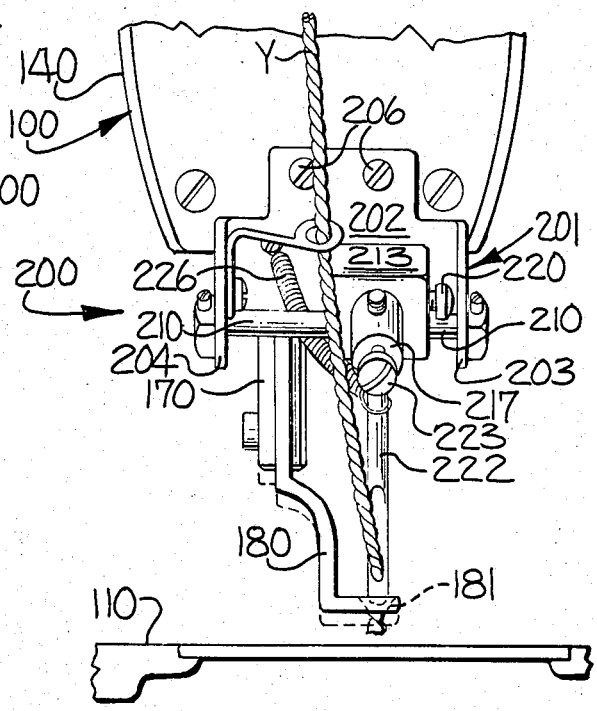
FIG. 4 is a side elevation of the yarn guide apparatus looking at the left-hand side of FIG. 3.
Figure 5:
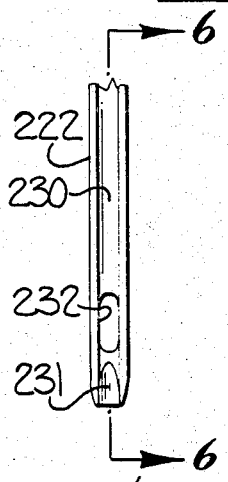
FIG. 5 is an enlarged detail view of the free end portion of the yarn guide finger, looking at the right-hand side thereof in FIG. 3, but omitting the yarn.
Figure 6:
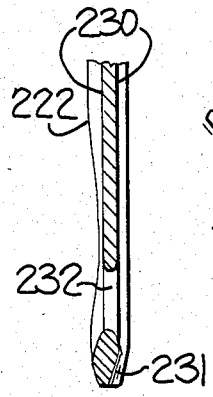
FIG. 6 is a cross-sectional view taken along line 6—6 of FIG. 5 and showing the free end portion of the yarn guide finger.
Figure 9:
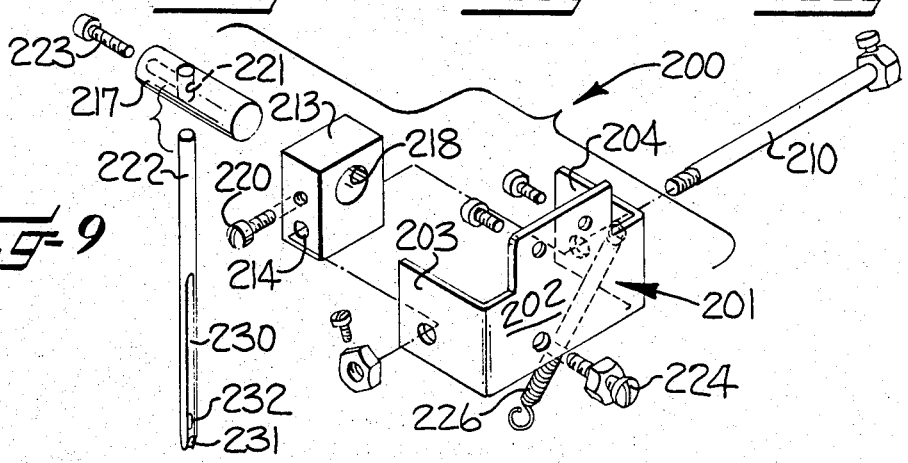
FIG. 9 is an exploded perspective view of the yarn guide apparatus of the invention removed from the sewing machine.

The yarn guide apparatus 200 serves to guide the effect yarn Y toward needle 160 for stitching the yarn Y to a substrate S (FIGS. 3, 4 and 9). To this end, the yarn guide apparatus 200 comprises a substantially U-shaped mounting bracket generally indicated at 201 having a middle section 202 and two opposing and outwardly extending ears 203, 204, respectively. The middle section 202 is attached to sewing machine head 140 by any suitable means such as screws 206. In addition, the ears 203, 204 of bracket 201 have opposite end portions of a shaft 210 journaled therein and extending therebetween, and so as to allow shaft 210 to rotate or oscillate freely in the bracket 201. A block 213 provided with a bore 214 (FIG. 9) is suitably secured on shaft 210 and is movable with the shaft between the ears of bracket 201. Block 213 also includes a second, larger bore 218 located in the upper portion thereof which is perpendicular to bore 214 for receiving and holding the cylindrical yarn guide finger mounting rod 217. A set screw 220 serves to secure the finger mounting rod 217 to the block 213. Mounting rod 217 is mounted perpendicular to block 213 and extends downwardly and outwardly away from sewing machine head 140.

Located in a medial portion of yarn guide finger mounting rod 217 is perpendicularly extending bore 221 in which a yarn guide finger 222 is slidably positioned. Yarn guide finger 222 is adjustably secured in bore 221 by means of a set screw 223 threaded into mounting rod 217. In order to adjustably limit the extent of inward movement of the yarn guide finger 222 toward the needle 160, an adjustable abutment or set screw 224 is provided which is threaded through the middle section 202 of bracket 201 and is adapted to be engaged by the finger carrying block 213. The yarn guide finger 222 is urged or biased to the inner position by a suitable biasing or spring means 226. It is thus apparent that the spring means 226 normally urges the block 213 toward the set screw 224, as best shown in FIG. 3.

Figure 7:
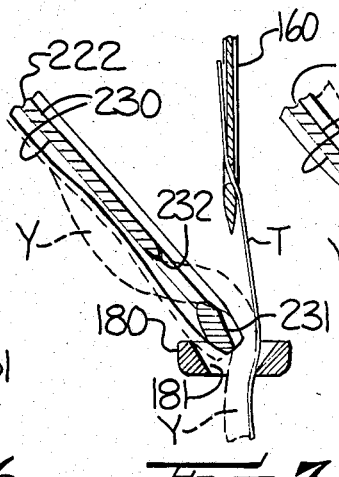
FIGS. 7 and 8 are vertical cross-sectional views illustrating the sewing needle in two different positions relative, to the yarn guide finger.
Figure 8:
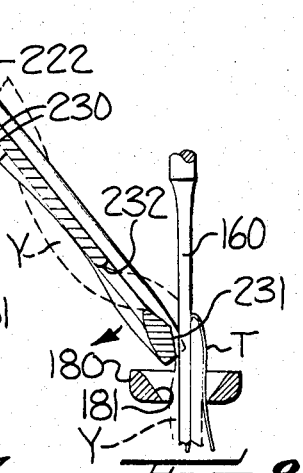

Yarn guide finger 222 in the illustrated embodiment extends generally downwardly and inwardly at an angle so that the free end thereof may underlie the path of travel of the quilting machine needle 160 when the needle occupies its raised position (see FIG. 7). Yarn guide finger 222 is provided with elongate channels 230 serving as yarn guiding grooves on opposite sides thereof which extend longitudinally along substantially the entire length of the finger 222 and which terminate in a grooved tip 231 which may be engaged by the needle 160 during the course of each downward stroke, as will be more fully explained hereinafter. Yarn guide finger 222 is provided with a yarn guide opening 232. This opening 232 is located near the free end portion of the yarn guide finger and is spaced above the grooved tip 231 for guiding the effect yarn Y toward needle 160 and for aiding in ensuring that needle 160 engages the center portion of yarn Y. In this regard, it is important to note that by the use of the yarn guide apparatus 200 of this invention, a much larger effect yarn may be applied to the substrate than could possibly be inserted through the eye of a conventional sewing needle such as that indicated at 160 in FIGS. 2, 3, 4, 7, and 8. Thus, it can be seen that a wider variety of decorative effects can be achieved by use of the apparatus of this invention.

The Method

According to the method of this invention, a decorative textile fabric is formed from a substrate S and a decorative effect yarn Y. Accordingly, it can be appreciated that the yarn guide finger 222 serves to guide the effect yarn Y in a predetermined path of travel as best illustrated in FIGS. 2, 3, 7 and 8, to a position adjacent the vertically reciprocating needle 160 of the sewing machine 100. Thus, as the needle 160 moves downwardly with each vertical reciprocation thereof, it engages and penetrates the effect yarn Y emerging from the yarn guide finger 222 and longitudinally compresses the effect yarn Y and causes the cross-sectional width of the effect yarn to expand by virtue of the engagement of the effect yarn by the needle 160 and by the stitching thread T carried by the needle. Thus, it is apparent that the continuing downward stroke of the needle and the stitching thread therein causes the stitching thread T to stitchingly secure the compressed effect yarn Y to the substrate S, as the needle cooperates with the shuttle (not shown) of the sewing machine and forms the stitching as shown in FIG. 12.

From the foregoing description, it can be appreciated that, during the course of each downward stroke of the needle 160 and the stitching thread carried thereby, the needle 160 engages effect yarn Y at a position some distance above the substrate S before the needle reaches the substrate S, thus advancing a substantial length of the effect yarn Y before the corresponding stitch is formed by the needle as it penetrates the effect yarn Y and the substrate S. Thus, as stated earlier herein, it has been determined that the effective length of the effect yarn between adjacent stitches of stitch thread T is in the range of about 1.5 to 8 times the linear distance between adjacent stitches.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A method of forming a decorative textile fabric from a substrate and an effect yarn which comprises guiding the effect yarn in a predetermined path of travel to a position adjacent a vertically reciprocating needle of a sewing machine while longitudinally compressing the effect yarn to expand the cross-sectional width of the effect yarn by engaging the effect yarn by the needle and by stitching thread carried by the needle during the downward stroke of the needle and while causing the stitching thread to stitchingly secure the compressed effect yarn to the substrate.

2. A method according to claim 1 wherein the substrate is a quilted fabric having lines of stitching therein and wherein the effect yarn is guided onto the substrate so that at least portions of the effect yarn overlie at least portions of the lines of stitching on the quilted fabric.

3. A method according to claim 1 wherein the effect yarn is guided onto the substrate so that portions of the effect yarn are arranged in overlapping relation and stitchingly secured in overlapping relation.

4. A method according to claim 1 wherein the sewing machine is a quilting machine and tne substrate is moved manually during the reciprocatory movement of the needle of the quilting machine so as to manually form the desired pattern on the substrate by the movement of the substrate.

5. An apparatus for sewing an effect yarn onto a substrate to form a textile article therefrom comprising a sewing machine having a needle mounted for vertical reciprocation, and a yarn guide apparatus comprising a yarn guide finger, and means mounting said yarn guide finger adjacent said needle and including means biasing said yarn guide finger toward said needle and into a first position in the path of reciprocation of the needle, and said yarn guide finger being movable to a second position outwardly away from said needle in response to the downward stroke of the needle.

6. An apparatus according to claim 5 wherein said means biasing said yarn guide finger toward said needle comprises spring means.

7. An apparatus according to claim 5 wherein said yarn guide finger is positioned to extend downwardly at an angle toward said needle of the sewing machine and said yarn guide finger has an opening therein adjacent its lower end through which the effect yarn is guided.

8. An apparatus according to claim, 7 wherein said yarn guide finger has longitudinal grooves therein extending along both sides thereof and communicating with said yarn guide opening therein.

9. A yarn guide apparatus adapted to be used in association with a sewing machine for guiding an effect yarn to a reciprocable needle of the sewing machine for forming a textile article therefrom, said yarn guide apparatus comprising a yarn guide finger, and mounting means adapted for mounting said yarn guide finger adjacent the reciprocable needle of the sewing machine and for biasing the same into a predetermined first position in the path of reciprocation of the needle, and said mounting means being constructed for movement of said guide finger from said first position to a second position outwardly away from the path of reciprocation of the needle while the guide finger is being biased back to said first position.

* * * * *